US008982028B2

(12) United States Patent
Lee

(10) Patent No.: US 8,982,028 B2
(45) Date of Patent: Mar. 17, 2015

(54) DISPLAY APPARATUS WITH IMPROVED DISPLAY CHARACTERISTICS AND COMMON VOLTAGE GENERATOR

(75) Inventor: Neung-Beom Lee, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 263 days.

(21) Appl. No.: 13/430,399

(22) Filed: Mar. 26, 2012

(65) Prior Publication Data

US 2012/0274624 A1 Nov. 1, 2012

(30) Foreign Application Priority Data

Apr. 27, 2011 (KR) ..... 10-2011-0039684

(51) Int. Cl.
*G09G 3/36* (2006.01)

(52) U.S. Cl.
CPC ..... *G09G 3/3648* (2013.01); *G09G 3/3655* (2013.01); *G09G 3/3614* (2013.01); *G09G 2320/0257* (2013.01)
USPC ..... 345/96

(58) Field of Classification Search
CPC ..... G09G 3/3614
USPC ..... 345/96, 87
See application file for complete search history.

(56) References Cited

U.S. PATENT DOCUMENTS

| | | | | |
|---|---|---|---|---|
| 5,541,619 | A * | 7/1996 | Hayashi et al. | 345/96 |
| 2004/0169627 | A1* | 9/2004 | Hong | 345/89 |
| 2006/0114209 | A1* | 6/2006 | Kim et al. | 345/94 |
| 2006/0238687 | A1* | 10/2006 | Su | 349/129 |
| 2007/0001963 | A1 | 1/2007 | Koma | |
| 2007/0030231 | A1* | 2/2007 | Lee et al. | 345/94 |
| 2007/0046604 | A1* | 3/2007 | Tseng et al. | 345/90 |
| 2007/0075960 | A1* | 4/2007 | Ito | 345/98 |
| 2007/0229447 | A1* | 10/2007 | Takahara et al. | 345/102 |
| 2008/0001886 | A1* | 1/2008 | Kim et al. | 345/94 |
| 2008/0055292 | A1* | 3/2008 | Do et al. | 345/204 |
| 2008/0136801 | A1* | 6/2008 | Shie | 345/204 |
| 2008/0180371 | A1* | 7/2008 | Shie | 345/87 |
| 2008/0180419 | A1* | 7/2008 | Tung et al. | 345/204 |
| 2008/0180589 | A1* | 7/2008 | Woo et al. | 349/38 |
| 2008/0224980 | A1* | 9/2008 | Senda et al. | 345/96 |
| 2008/0297538 | A1* | 12/2008 | Cho et al. | 345/690 |
| 2009/0167659 | A1* | 7/2009 | Kim et al. | 345/89 |
| 2009/0237340 | A1 | 9/2009 | Park et al. | |
| 2009/0284492 | A1* | 11/2009 | Chino | 345/174 |
| 2012/0113084 | A1* | 5/2012 | Yang et al. | 345/212 |

FOREIGN PATENT DOCUMENTS

| | | | |
|---|---|---|---|
| KR | 1020050006431 | A | 1/2005 |
| KR | 1020080076578 | A | 8/2008 |

* cited by examiner

*Primary Examiner* — Claire X Pappas
*Assistant Examiner* — Robert Stone
(74) *Attorney, Agent, or Firm* — Innovation Counsel LLP

(57) ABSTRACT

A display apparatus includes a first substrate, a second substrate, a liquid crystal layer, and a common electrode. The first substrate includes a gate line, a data line insulated from the gate line while crossing the gate line, and a pixel electrode connected to the gate line and the data line. The second substrate faces the first substrate. The liquid crystal layer is interposed between the first substrate and the second substrate. The common electrode is disposed on at least one of the first substrate or the second substrate to form an electric field in cooperation with the pixel electrode. A data voltage applied to the pixel electrode has a polarity inverted every at least one frame with reference to a predetermined reference voltage, and a common voltage applied to the common electrode has a polarity inverted every at least two frames with reference to the reference voltage.

17 Claims, 5 Drawing Sheets

DISPLAY APPARATUS WITH IMPROVED DISPLAY CHARACTERISTICS AND COMMON VOLTAGE GENERATOR

CROSS-REFERENCE TO RELATED APPLICATION

This application relies for priority upon Korean Patent Application No. 10-2011-0039684 filed on Apr. 27, 2011, the contents of which are herein incorporated by reference in its entirety.

BACKGROUND

1. Field of Disclosure

The present invention relates to a display apparatus. More particularly, the present invention relates to a display apparatus capable of improving display characteristics.

2. Description of the Related Art

In general, a liquid crystal display includes a first substrate, a second substrate facing the first substrate, and a liquid crystal layer interposed between the first and second substrates. The first substrate includes a gate line, a data line, a thin film transistor connected to the gate line and the data line, and a pixel electrode connected to the thin film transistor.

A data voltage is applied to the pixel electrode to form an electric field in the liquid crystal layer which controls the orientation of the liquid crystals, thereby displaying an image. The data voltage is applied to the pixel electrode through a thin film transistor that is turned on when a gate voltage is at a logic high level. Then the data voltage applied to the pixel electrode is varied by a kickback voltage caused by a parasitic capacitance and is maintained at the varied voltage level when the gate voltage is changed to a logic low level.

Accordingly, when the thin film transistor is turned on, the voltage initially applied to the pixel electrode is not maintained though the one frame, and the liquid crystal display does not display the image on the desired gray scale, thereby deteriorating display characteristics.

SUMMARY

A display apparatus capable of improving display characteristics is provided.

The display apparatus includes a first substrate, a second substrate, a liquid crystal layer, and a common electrode.

The first substrate includes a gate line, a data line insulated from the gate line while crossing the gate line, and a pixel electrode connected to the gate line and the data line. The second substrate faces the first substrate. The liquid crystal layer is interposed between the first substrate and the second substrate. The common electrode is disposed on at least one of the first substrate or the second substrate to form an electric field with the pixel electrode.

The pixel electrode is applied with a data voltage and the common electrode is applied with a common voltage. The data voltage has a polarity inverted every at least one frame with reference to a predetermined reference voltage, and the common voltage has a polarity inverted every at least two frames with reference to the reference voltage.

The common voltage applied to the common electrode has the polarity inverted every at least two frames with reference to the reference voltage, and thus a direct current bias voltage may be prevented from being formed in the pixel electrode or an alignment layer, thereby removing an afterimage on the display apparatus. As a result, the display characteristics may be improved.

BRIEF DESCRIPTION OF THE DRAWINGS

The above and other advantages will become readily apparent by reference to the following detailed description when considered in conjunction with the accompanying drawings wherein.

DETAILED DESCRIPTION

Figure 1:
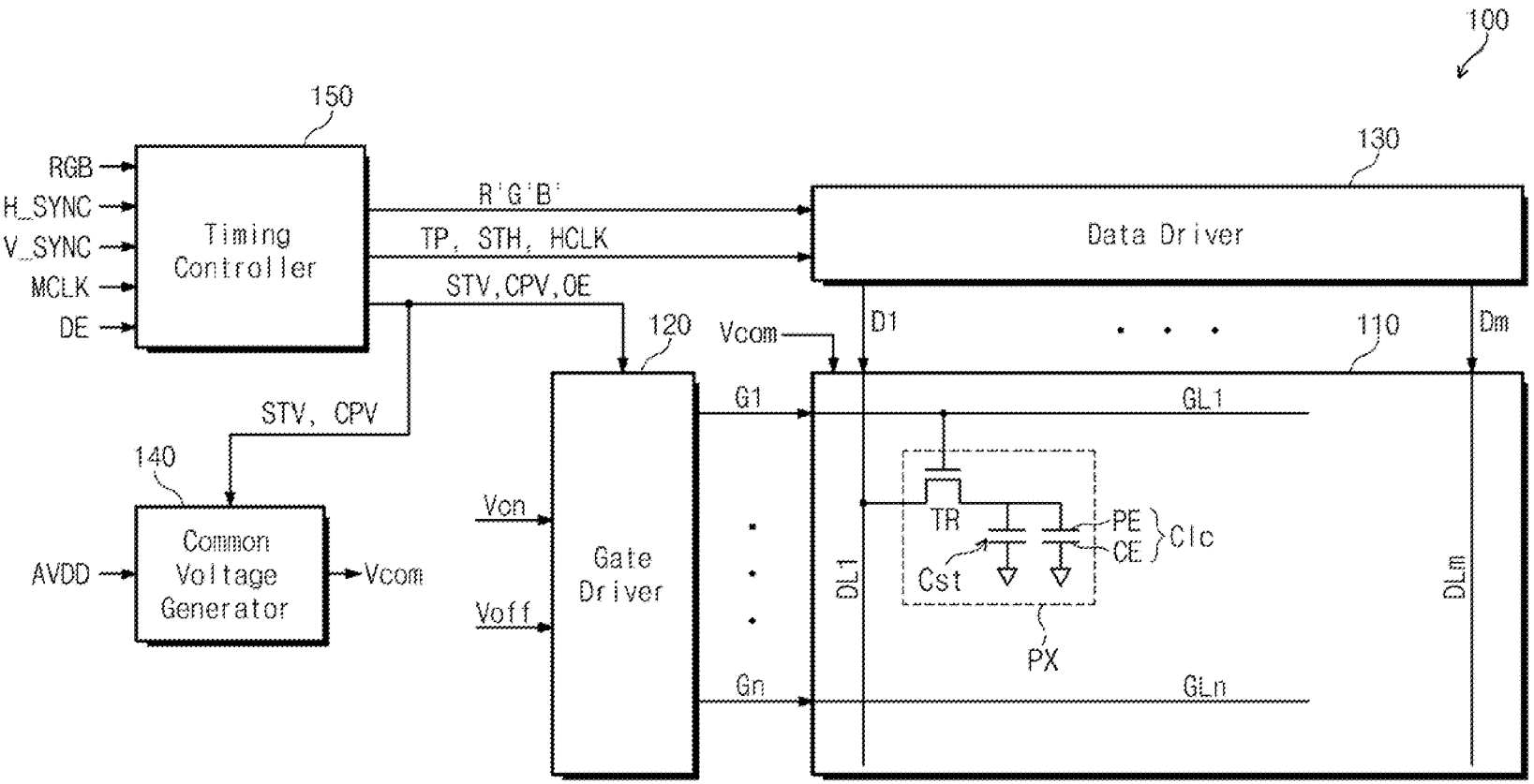
FIG. 1 is a block diagram showing a display apparatus according to an exemplary embodiment.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below, depending on the orientation. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a," "an" and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the relevant art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the example embodiments will be explained in detail with reference to the accompanying drawings.

FIG. 1 is a block diagram showing a display apparatus according to an exemplary embodiment.

Referring to FIG. 1, a display apparatus 100 includes a display panel 110, a gate driver 120, a data driver 130, a timing controller 150, and a common voltage generator 140.

The timing controller 150 receives image signals RGB and control signals, such as a horizontal synchronization signal H_SYNC, a vertical synchronization signal V_SYNC, a reference clock signal MCLK, and a data enable signal DE.

The timing controller 150 converts the data format of the image signals RGB into a data format appropriate for the interface between the data driver 130 and the timing controller 150, and provides the converted image signals R'G'B' to the data driver 130. In addition, the timing controller 150 applies data control signals, such as an output start signal TP, a horizontal start signal STH, a clock signal HCLK, etc., to the data driver 130, and applies gate control signals, such as a vertical start signal STV, a gate clock signal CPV, an output enable signal OE, etc., to the gate driver 120.

The gate driver 120 receives a gate-on signal Von and a gate-off signal Voff from an external device (not shown) and sequentially outputs gate signals G1 to Gn that each have a voltage level of the gate-on signal Von in response to the gate control signals STV, CPV, and OE.

The data driver 130 generates a plurality of gray scale voltages using gamma voltages provided from a gamma voltage generator (not shown). In addition, the data driver 130 selects gray scale voltages corresponding to the image signals R'G'B' in response to the data control signals TP, STH, and HCLK, and outputs the selected gray scale voltages as data voltages D1 to Dm.

The display panel 110 includes a plurality of gate lines GL1 to GLn, a plurality of data lines DL1 to DLm crossing the gate lines GL1 to GLn. The display panel 110 also includes pixels PX.

In the present exemplary embodiment, each of the pixels PX have the same structure and function, so only one pixel PX is shown in FIG. 1 as a representative example.

Each pixel PX includes a thin film transistor TR, a liquid crystal capacitor Clc, and a storage capacitor Cst. The thin film transistor TR includes a gate electrode connected to a corresponding gate line of the gate lines GL1 to GLn, a source electrode connected to a corresponding data line of the data lines DL1 to DLm, and a drain electrode connected to a pixel electrode PE and a storage capacitor Cst.

The gate lines GL1 to GLn are connected to the gate driver 120 and the data lines DL1 to DLm are connected to the data driver 130. The gate lines GL1 to GLn each receive the gate signal G1 to Gn provided from the gate driver 120, and the data lines DL1 to DLm receive the data voltages provided from the data driver 130.

The thin film transistor TR in each pixel PX is turned on in response to the gate signal applied through the corresponding gate line of the gate lines GL1 to GLn, and the data voltage applied to the corresponding data line is applied to the pixel electrode PE through the turned-on thin film transistor. Meanwhile, a common electrode CE, which faces the pixel electrode PE to form an electric field, is applied with a common voltage.

The electric field is formed between the pixel electrode PE and the common electrode CE, and corresponds to an electric potential difference between the common voltage and the data voltage. Each pixel PX controls light transmittance of the liquid crystal layer according to the intensity of the electric field to display an image.

Although not shown in FIG. 1, the display apparatus 100 may further include a backlight unit disposed adjacent to the display panel 110 to provide light to the display panel 110. The backlight unit includes a plurality of light sources including light emitting diodes (LEDs) or cold cathode fluorescent lamps (CCFLs).

Figure 2:
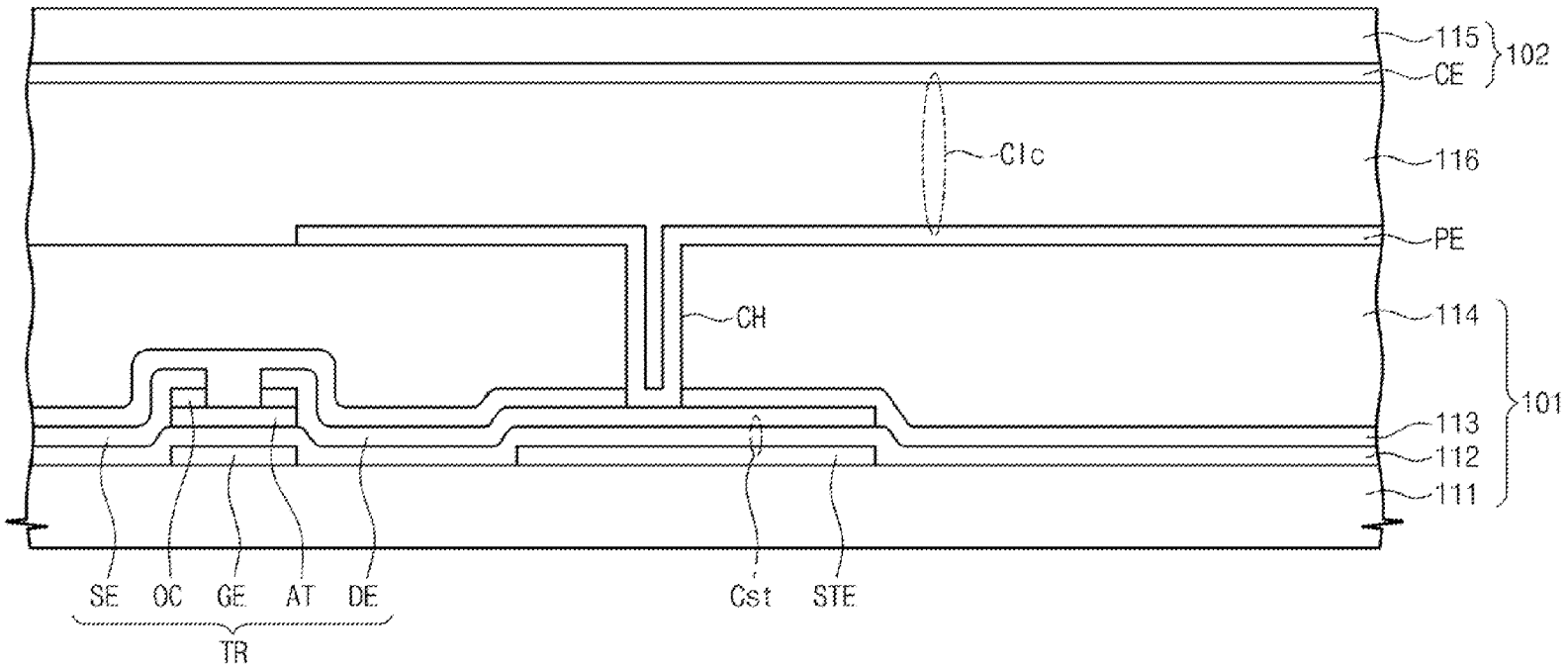
FIG. 2 is a cross-sectional view showing a pixel area according to an exemplary embodiment.

FIG. 2 is a cross-sectional view showing an area of a pixel PX according to an exemplary embodiment.

Referring to FIG. 2, the display panel 110 includes a first substrate 101, a second substrate 102 facing the first substrate 101, and a liquid crystal layer 116 interposed between the first substrate 101 and the second substrate 102.

The first substrate 101 includes a first base substrate 111, and the first base substrate 111 includes a gate electrode GE and a storage electrode, which are formed on the base substrate 111. The first base substrate 111 may be formed of a flexible material, such as, for example, polyethylene terephthalate (PET), fiber reinforced plastic (FRP), or polyethylene naphthalate (PEN).

A gate insulating layer 112 is disposed on the base substrate 111 to cover the gate electrode GE and the storage electrode STE. An active layer AT and an ohmic contact layer OC may be formed on the gate insulating layer 112 over the gate electrode GE. In addition, a source electrode SE and a drain electrode DE are formed on the gate electrode GE with the gate insulating layer 112, the active layer AT, and the ohmic contact layer OC interposed between the gate electrode GE and the source and drain electrodes SE and DE. The source electrode SE and the drain electrode DE are spaced apart from each other. The drain electrode DE and the storage electrode STE form the storage capacitor Cst by using the gate insulating layer 112 as a dielectric substance.

The gate electrode GE, the active layer AT, the ohmic contact layer OC, the source electrode SE, and the drain electrode DE form the thin film transistor TR. A protection layer 113 may be disposed on the gate insulating layer 112 to cover the thin film transistor TR. In addition, an organic insulating layer 114 including an organic material may be further disposed on the protection layer 113. As an example, the protection layer 113 may include silicon nitride (SiNx).

The protection layer 113 and the organic insulating layer 114 are provided with a contact hole CH formed therethrough to expose a portion of the drain electrode DE. The pixel electrode PE is disposed on the organic insulating layer 114 and electrically connected to the drain electrode DE through the contact hole CH.

The second substrate 102 includes a second base substrate 115 and the common electrode CE disposed on the second base substrate 115. FIG. 2 shows the common electrode CE disposed on the second base substrate 115, but it should not be limited thereto or thereby. That is, for example, the common electrode CE may be disposed on the first base substrate 111. In addition, although not shown in FIG. 2, the second base substrate 115 may further include a black matrix and/or a color filter formed thereon.

The liquid crystal layer 116 is disposed between the first substrate 101 and the second substrate 102. The pixel electrode PE and the common electrode CE form the liquid crystal capacitor Clc using the liquid crystal layer 116 as a dielectric substance. The liquid crystal layer 116 controls the transmittance of light through the display panel according to voltages respectively applied to the pixel electrode PE and the common electrode CE.

Figure 3:
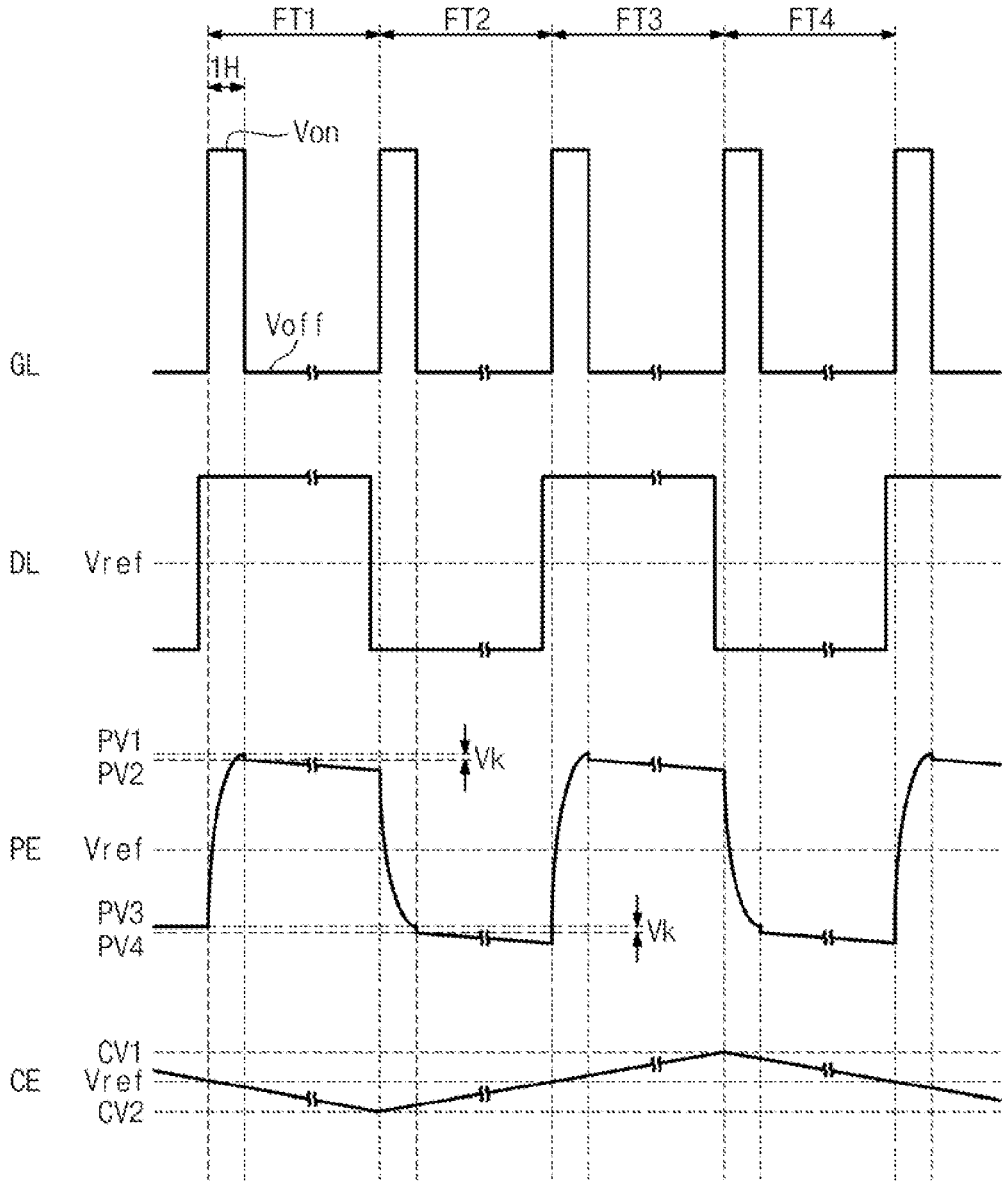
FIG. 3 is a timing diagram of signals applied to a pixel shown in FIG. 1.

FIG. 3 is a timing diagram of signals applied to a pixel shown in FIG. 1. In particular, FIG. 3 shows the voltages applied to the gate line GL, the data line DL, the pixel electrode PE, and the common electrode CE during a first frame FT1, a second frame FT2, a third frame FT3, and a fourth frame FT4. In addition, FIG. 3 shows the signals applied to the pixels connected to one of a plurality of gate lines GL1 to GLN of the display panel 110.

Referring to FIG. 3, the gate-on signal Von is input to the gate line GL during 1H time period within one frame, and then the gate-on signal Voff is input to the gate line GL. The gate-on signal Von and the gate-off signal Voff are repeatedly input to the gate line GL every one frame time period.

The data voltage is input to the data line DL and the data voltage has a polarity inverted that is every one frame time period. Because the data voltage is applied to the pixel electrode PE when the gate-on signal Von is input to the gate line GL, as shown in FIG. 3, the polarity of the data voltage is changed to a positive (+) polarity from a negative (−) polarity, or to the negative polarity from the positive polarity, shortly before the gate-on signal Von is input. FIG. 3 shows only the polarity of the data voltage applied to the data line DL, and the level of the data voltage may be substantially varied every 1H time period.

In the first frame FT1, when the gate-on signal Von is applied to the gate line GL, the pixel electrode PE is charged with the data voltage that has been applied to the data line DL. Thus, the charged voltage in the pixel electrode PE gradually increases during the 1H time period to a first pixel voltage PV 1. The first pixel voltage PV 1, which is charged in the pixel electrode PE during the 1H time period in which the gate-on signal Von is input, is lowered by a kickback voltage Vk when the gate-off signal Voff is applied to the gate line GL, and thus the pixel electrode PE is charged with a second pixel voltage PV2. The kickback voltage Vk is generated by a parasitic capacitance between the pixel electrode PE and the gate line GL when the gate-on signal Von is changed to the gate-off voltage Voff. The second pixel voltage PV2 is maintained at its level until the second frame FT2 starts.

In the second frame FT2, when the gate-on signal Von is applied to the gate line GL, the charged voltage applied to the pixel electrode PE is changed to a third pixel voltage PV3 during the 1H time period. Because the data voltage input to the data line DL in the second frame FT2 has a polarity that is opposite to the polarity of the data voltage in the first frame FT1, the third pixel voltage PV3 has a polarity that is opposite to the polarity of the first pixel voltage PV1. During the second frame FT2, when the gate-off signal Voff is input to the gate line GL after the gate-on signal Von, the third pixel voltage PV3 charged in the pixel electrode PE is lowered by the kickback voltage Vk. Accordingly, the pixel electrode PE maintains a fourth pixel voltage PV4 until the fourth frame FT4 starts. In the third and fourth frames FT3 and FT4 the data voltage is applied to the pixel electrode PE as it was in the first and second frames FT1 and FT2.

As can be seen from FIG. 3, although the data voltage applied to the data line DL has the polarity inverted at every one frame, a direct current bias voltage may be generated in the pixel electrode PE (in other words, the average waveform is below Vref) because the voltage charged in the pixel electrode PE is lowered by the kickback voltage Vk every frame. Due to the direct current bias voltage, ionic impurities existing in the liquid crystal layer, the organic insulating layer, or the color filter may be attached to the pixel electrode PE, the common electrode CE, and an alignment layer (not shown) disposed on the pixel electrode PE and the common electrode CE, thereby deteriorating display characteristics of the display apparatus 100.

To remove the direct current bias voltage, the common voltage that is applied to the common electrode CE is inverted for every two frames. In particular, the voltage of the common electrode CE is gradually decreased to a second common voltage CV2 from a reference voltage Vref during the first frame FT1, and the voltage of the common electrode CE is gradually increased to a first common voltage CV1 from the second common voltage CV2 during the second and third frames FT2 and FT3 together. In addition, the voltage of the common electrode CE is gradually decreased to the reference voltage Vref from the first common voltage CV1 in the fourth frame FT4. As described above, when the common voltage applied to the common electrode CE is gradually decreased or increased across every two frames, a direct current bias voltage generated in earlier two frames may be offset by the direct current bias voltage generated in later two frames, because the direct current bias voltage generated in the earlier two frames has an opposite polarity to the polarity of direct current bias voltage generated in the later two frames. The first common voltage CV1 and the second common voltage CV2 have different polarities from each other with reference to the reference voltage Vref, but have the same absolute voltage level.

Although not shown in FIG. 3, the kickback voltage Vk may depend on the level of the data voltage. For instance, assuming that the display apparatus 100 is operated in a normally black mode, the kickback voltage Vk generated is about 1.28 volts when a high voltage is applied as the data voltage to display a white gray scale, and the kickback voltage Vk generated is about 1.71 volts when a low voltage is applied as the data voltage to display a black gray scale. In general, the kickback voltage generated when the data voltage is applied at a high voltage is lower than that when the data voltage is applied at a low voltage.

As used herein, a first kickback voltage refers to a kickback voltage generated when a voltage corresponding to a white gray scale is applied as the data voltage and a second kickback voltage refers to the kickback voltage generated when a voltage corresponding to a black gray scale is applied as the data voltage. A voltage difference between the first common voltage and the reference voltage may be equal to or larger than the first kickback voltage and the second kickback voltage. Thus, the voltage difference between the first common voltage CV1 and the reference voltage Vref and the voltage difference between the second common voltage DV2 and the reference voltage Vref may be respectively equal to or larger than the first kickback voltage of about 1.28 volts and the second kickback voltage of about 1.72 volts.

The voltage difference between the first common voltage CV1 and the reference voltage Vref or the voltage difference between the second common voltage CV2 and the reference voltage Vref may be equal to or larger than a voltage difference between the first kickback voltage and the second kickback voltage. Accordingly, the voltage difference between the first common voltage and the reference voltage or the voltage difference between the second common voltage and the reference voltage may be equal to or larger than the voltage difference of about 0.43 volts (1.71 volts−1.28 volts) between the first kickback voltage and the second kickback voltage.

FIG. 3 shows the common voltage applied to the common electrode CE is inverted, that is, changes from increasing to decreasing or from decreasing to increasing, every two frames, but the common voltage applied to the common electrode CE may be inverted every 2N (N is a constant number equal to or larger than 1) frames. For instance, in the case that the data voltage is inverted every at least one frame with reference to the reference voltage Vref, the common voltage applied to the common electrode CE may be inverted every at least two frames with reference to the reference voltage Vref. In addition, in the case that the data voltage is inverted every at least two frames with reference to the reference voltage Vref, the common voltage applied to the common electrode CE may be inverted every 4N frames with reference to the reference voltage Vref.

Figure 4:
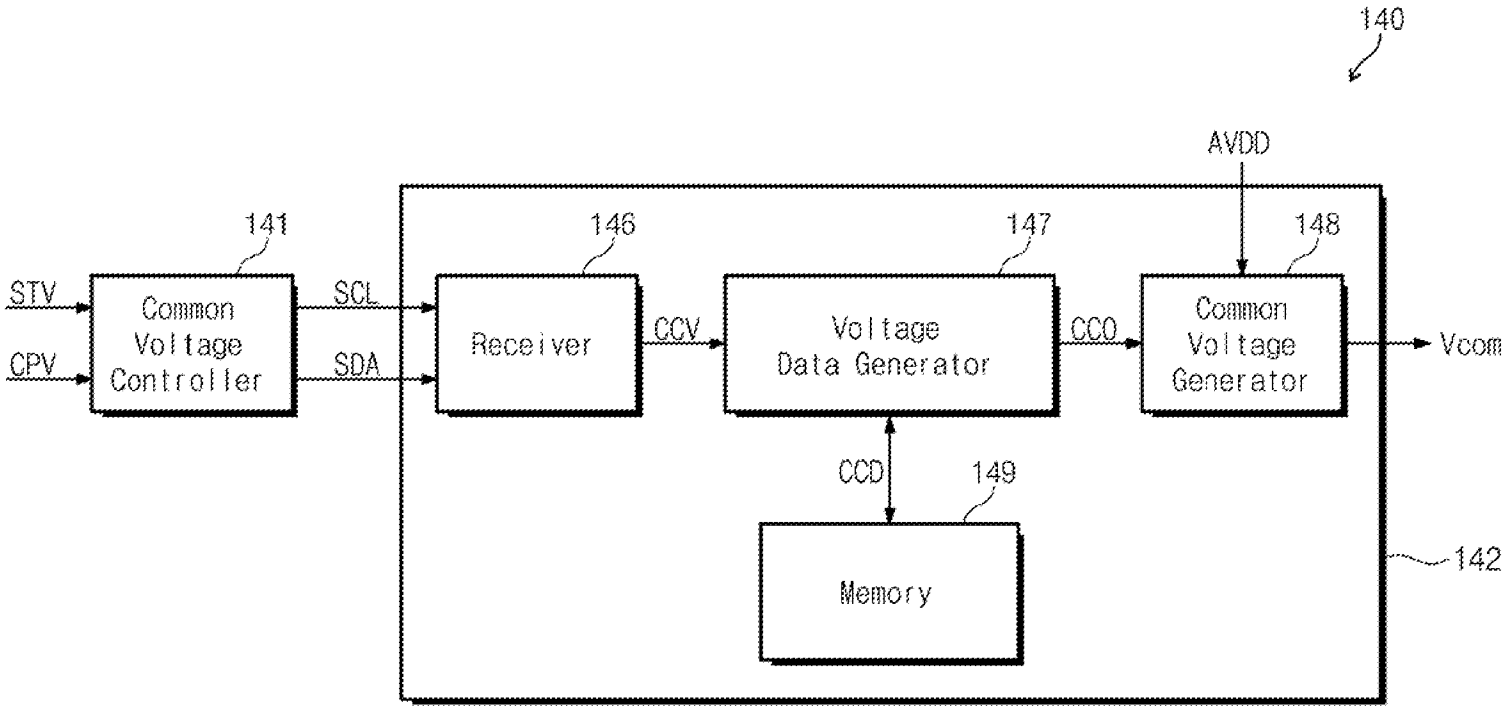
FIG. 4 is a block diagram showing a common voltage generator shown in FIG. 1.

FIG. 4 is a block diagram showing a common voltage generator 140 shown in FIG. 1.

Referring to FIG. 4, the common voltage generator 140 includes a common voltage controller 141 and a common voltage output part 142.

The common voltage controller 141 receives the vertical start signal STV and the gate clock signal CPV among the gate control signals from the timing controller 150 to output common voltage control signals, such as, for example, a control clock signal SCL and a control data signal SDA. The common voltage generator 141, for example, may be a complex programmable logic device. The control clock signal SCL and the control data signal SDA are used to transmit data in a parallel two-port network.

The control clock signal SCL and the control data signal SDA have been shown as an example. The common voltage controller 141 may transmit the common voltage control signals using a variety of methods.

The common voltage output part 142 includes a receiver 146, a memory 149, a voltage data generator 147, and a common voltage generator 148.

The receiver 146 receives the control clock signal SCL and the control data signal SDA to output a common voltage control value CCV. In the case that the common voltage control signal includes, for example, 7-bit information, the common voltage control value CCV may include 7-bit information. The receiver 146, for example, may be an Inter-Integrated Circuit ($I^2C$) that receives the data in the parallel two-port. The memory 149 stores a common voltage output value CCO corresponding to the common voltage control value CCV as common voltage data CCD.

The voltage data generator 147 receives the common voltage control value CCV and outputs the common voltage output value CCO corresponding to the common voltage control value CCV to the common voltage generator 148 with reference to the common voltage data CCD stored in the memory 149.

The common voltage generator 148 receives a driving voltage (e.g., an analog power source voltage) from an external device and outputs the common voltage Vcom corresponding to the common voltage output value CCO. To this end, although not shown in FIG. 4, the common voltage generator 148 may include a plurality of resistor strings that receive the analog power source voltage AVDD and generate a desired voltage. Accordingly, the common voltage output part 142 may output one of 128 voltages having different levels from each other between the first common voltage CV1 and the second common voltage CV2 as the common voltage Vcom.

According to FIG. 4, the common voltage controller 148 receives the vertical start signal STV and the gate clock signal CPV to output common voltage control signals, but it should not be limited thereto or thereby. That is, the common voltage controller 148 may, for example, output the common voltage control signals by partially using the data control signals.

In addition, the circuit diagram needed to generate the common voltage shown in FIG. 3 should not be limited to the common voltage generator 140 shown in FIG. 4.

Figure 5:
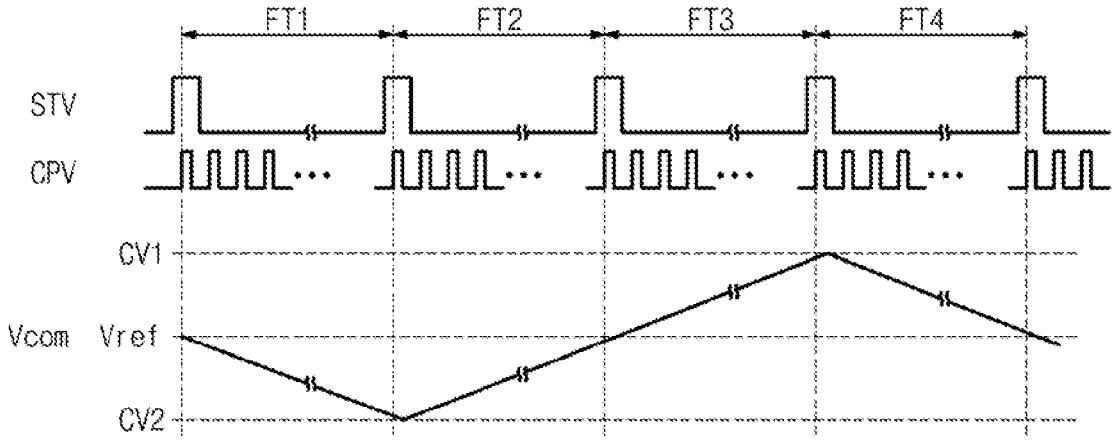
FIG. 5 is a timing diagram of signal input to or output from the common voltage generator shown in FIG. 1.

FIG. 5 is a timing diagram of signal input to or output from the common voltage generator shown in FIG. 1.

Referring to FIG. 5, during one frame, after a high period of the vertical start signal STV is generated until a next high period of the vertical start signal STV is generated, the high period of the gate clock signal CPV may occur about 1080 times. For instance, because a full HDTV has a vertical resolution of 1080 and the gate signal is output 1080 times during one frame, the gate clock signal CPV includes a high period of 1080 times.

The common voltage Vcom applied to the common voltage CE is swung between the first common voltage CV1 and the second common voltage CV2 every four frames. In other words, the common voltage Vcom has the polarity inverted every two frames between the first common voltage CV1 and the second voltage CV2, and the common voltage Vcom is gradually increased or decreased after dividing the range between the first common voltage CV1 and the second common voltage CV2 into 128 steps.

Since the common voltage Vcom has the waveform repeated every four frames and is increased or decreased between the first and second common voltages CV1 and CV2 during two frames, the common voltage Vcom is increased or decreased in 64 steps between the first and second common voltages CV1 and CV2 during one frame. Thus, because the gate clock signal CPV has the high periods of about 1080 times during the first frame FT1 after a first high period of the vertical start signal STV starts, the voltage level of the common voltage Vcom may be increased or decreased by one step every time when the high period of the gate clock signal CPV occurs about 17 times (1080/64=16.875). For example, in the case that the first common voltage CV1 and the second common voltage CV2 is about 0.5 volts, the common voltage Vcom may be increased by about 8 mV (0.5/64=0.0078) whenever the high period of the gate clock signal CPV occurs about 17 times.

In other words, referring to FIG. 5, the voltage level of the common voltage Vcom is decreased by one step about every seventeenth time the high period of the gate clock signal CPV occurs during the first frame FT1 after the first high period of the vertical start signal STV occurs. Thus, the common voltage Vcom is gradually increased to the second common voltage CV2 from the reference voltage Vref. In addition, the voltage level of the common voltage Vcom is increased by one step about every seventeenth time the high period of the gate clock signal CPV occurs during the second and third frames FT2 and FT3 after a second high period of the vertical start signal STV occurs. Thus, the common voltage Vcom is gradually increased to the first common voltage CV1 from the second common voltage CV2. Then, as the voltage level of the common voltage Vcom is decreased by one step about every seventeenth time the high period of the gate clock signal CPV occurs during the fourth frame FT4 after the first high period of the vertical start signal STV occurs, the common voltage Vcom is gradually decreased to the reference voltage Vref from the first common voltage CV1.

Thus, when the common voltage generator 140 increases or decreases the level of the common voltage Vcom by one step about every seventeenth time the high period of the gate clock signal CPV occurs, and controls the direction of variation of the common voltage Vcom whenever the high period of the vertical start signal STV occurs every two times, the common voltage Vcom may be swung every four frames with respect to the reference voltage Vref.

FIG. 5 shows the timing diagram indicating the common voltage Vcom that is swung periodically with reference to the reference voltage Vref, but it should not be limited thereto or thereby.

Figure 6:
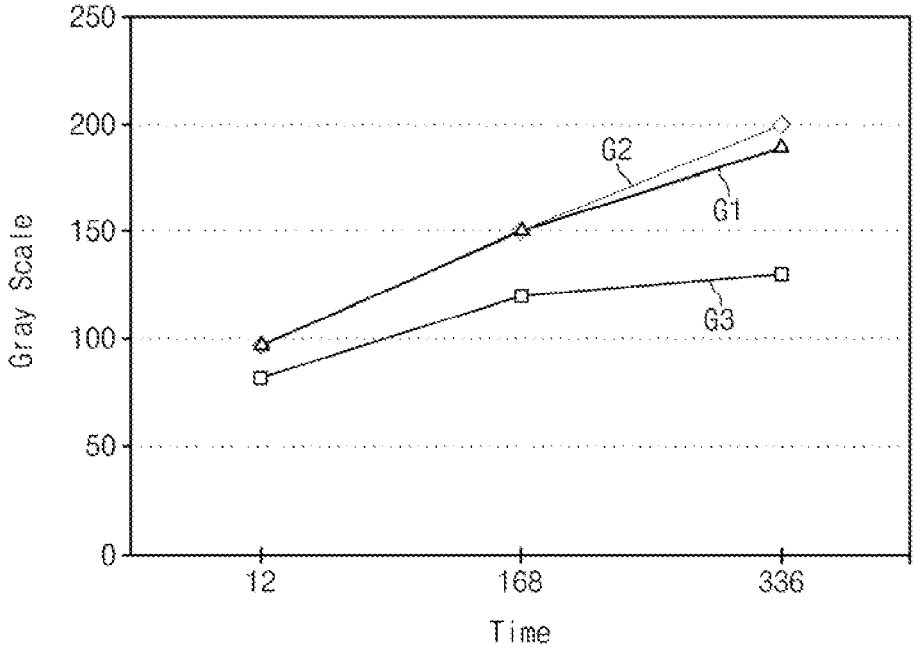
FIG. 6 is a graph showing display characteristics as a function of the time in use of the display apparatus shown in FIG. 1.

FIG. 6 is a graph showing the afterimage degree for the display apparatus shown in FIG. 1 with respect to the time in use. In detail, referring to Table 1 shown below, a first graph G1 shows the afterimage degree of the display apparatus when the common voltage Vcom is maintained in a constant level of about 8.1 volts, a second graph G2 shows the afterimage degree of the display apparatus when the common voltage Vcom is swung within a range of 8.1±0.5 volts with a reference voltage of about 8.1 volts every one frame, that is, when the polarity of the common voltage Vcom is inverted every half frame, and a third graph G3 shows the afterimage degree of the display apparatus when the common voltage Vcom is swung within a range of 8.1±0.5 volts with a reference voltage of about 8.1 volts every 3600 frames, that is, when the polarity of the common voltage Vcom is inverted every 1800 frames.

TABLE 1

| Graph | Experimental condition | Gray scale levels where boundaries between areas are not perceived | | |
|---|---|---|---|---|
| First graph | Common voltage: 8.1 V fixed | 98 | 150 | 190 |
| Second graph | Common voltage: 8.1 ± 0.5 V Common voltage is swung every one frame | 99 | 150 | 200 |
| Third graph | Common voltage: 8.1 ± 0.5 V Common voltage is swung every 3600 frames | 82 | 120 | 130 |

In FIG. 6, the horizontal axis represents the time in use of the display apparatus, and the vertical axis represents gray scales at which the afterimage does not appear. For instance, the afterimage degree of the display apparatus is tested by the following processes. First, the display surface of the display apparatus is divided into areas having a matrix arrangement with seven rows and seven columns, and a white image and a black image are alternately displayed on each area so that the display apparatus displays a checkered pattern. Then, while the display apparatus sequentially displays the image on the whole of the display surface from a white image to a black image, for the areas in which boundaries of the areas cannot be perceived as the image changes, the levels of the gray scales are determined. Accordingly, the afterimage degree is low when the levels of the gray scales for the areas where the boundaries of the areas are not perceived are low, and the afterimage degree is high when the levels of the gray scales of the areas where the boundaries of the areas are not perceived are high.

Referring to FIG. 6, when the common voltage Vcom is swung by about 0.5 volts every 3600 frames with reference to the reference voltage, the levels of the gray scales of the third graph G3 at which the afterimage is perceived are lower than the levels of the gray scales of the first graph G1 and the second graph G2 when the afterimage is perceived. Thus, when the common voltage Vcom is swung every 4N frames with reference to the reference voltage, the afterimage degree may be reduced.

Although the exemplary embodiments have been described, it is understood that the present disclosure should not be limited to these exemplary embodiments but various changes and modifications can be made by one ordinary skilled in the art within the spirit and scope of the present disclosure including the following claims.

What is claimed is:

1. A display apparatus comprising:

a first substrate comprising a gate line, a data line insulated from the gate line while crossing the gate line, and a pixel electrode connected to the gate line and the data line;

a second substrate facing the first substrate;

a liquid crystal layer interposed between the first substrate and the second substrate; and a common electrode disposed on at least one of the first substrate or the second substrate to form an electric field with the pixel electrode, wherein the pixel electrode is applied with a data voltage, the common electrode is applied with a common voltage, the data voltage has a polarity inverted every at least one frame with reference to a predetermined reference voltage, the common voltage has a polarity inverted every at least two frames with reference to the reference voltage, and a voltage level of the common voltage is gradually changed between a first voltage and a second voltage, the second voltage having a polarity different from a polarity of the first voltage with reference to the reference voltage, and wherein the polarity of the data voltage is inverted once every two frames with reference to the reference voltage and the polarity of the common voltage is inverted once every 4N (N is a constant number equal to or larger than 1) frames with reference to the reference voltage.

2. The display apparatus of claim 1, wherein the polarity of the common voltage is inverted once every 2N (N is a constant number equal to or larger than 1) frames with reference to the reference voltage.

3. The display apparatus of claim 2, wherein the polarity of the data voltage is inverted every one frame with reference to the reference voltage.

4. The display apparatus of claim 1, wherein the voltage level of the common voltage is gradually decreased to the second voltage from the first voltage during at least two frames, and the common voltage is gradually increased to the first voltage from the second voltage during at least two frames.

5. The display apparatus of claim 4, wherein a voltage difference between the first voltage and the reference voltage is equal to a voltage difference between the second voltage and the reference voltage.

6. The display apparatus of claim 4, wherein, when a kickback voltage generated when a voltage corresponding to a white gray scale is applied as the data voltage is referred to as a first kickback voltage and a kickback voltage generated when a voltage corresponding to a black gray scale is applied as the data voltage is referred to as a second kickback voltage, a voltage difference between the first voltage and the reference voltage is equal to or larger than a difference between the first kickback voltage and the second kickback voltage.

7. The display apparatus of claim 4, wherein, when a kickback voltage generated when a voltage corresponding to a white gray scale is applied as the data voltage is referred to as a first kickback voltage and a kickback voltage generated when a voltage corresponding to a black gray scale is applied as the data voltage is referred to as a second kickback voltage, a voltage difference between the first voltage and the reference voltage is equal to or larger than each of the first kickback voltage and the second kickback voltage.

8. The display apparatus of claim 4, further comprising:

a gate driver that receives a gate control signal and is configured to apply a gate signal to the gate line;

a data driver that receives an image signal and a data control signal and is configured to apply the data voltage to the data line;

a timing controller that is configured to output the image signal, the data control signal, and the gate control signal; and a common voltage generator that is configured to receive at least a portion of the gate control signal and the data control signal to output the common voltage.

9. The display apparatus of claim 8, wherein the common voltage generator comprises:

a common voltage controller that is configured to receive at least a portion of the gate control signal and the data control signal to output a common voltage control signal; and a common voltage output part that is configured to receive the common voltage control signal to output the common voltage.

10. The display apparatus of claim 9, wherein the common voltage controller is a complex programmable logic device.

11. The display apparatus of claim 9, wherein the common voltage controller receives a vertical synchronization signal and a gate clock signal from the timing controller to output the common voltage control signal.

12. The display apparatus of claim 9, wherein the common voltage output part comprises:

a receiver that is configured to receive the common voltage control signal to output a common voltage control value;

a memory that is configured to store a common voltage output value corresponding to the common voltage control value as a common voltage data;

a voltage data generator that is configured to receive the common voltage control value to output the common voltage output value corresponding to the common voltage control value with reference to the common voltage data; and a common voltage generator that is configured to receive the common voltage output value to output the common voltage having a level corresponding to the common voltage output value.

13. The display apparatus of claim 12, wherein the receiver is an Inter-Integrated Circuit ($I^2C$).

14. The display apparatus of claim 13, wherein the common voltage control signal comprises a clock signal and a data signal and is transmitted through a parallel two-port network.

15. The display apparatus of claim 9, further comprising a switching device including a gate electrode connected to the gate line, a source electrode connected to the data line, and a drain electrode connected to the pixel electrode.

16. The display apparatus of claim 9, wherein the common voltage control signal is a 7-bit control signal and the common voltage output part outputs one of 128 voltages having different levels from each other between the first voltage and the second voltage as the common voltage.

17. The display apparatus of claim 1, wherein the electric field is formed in the liquid crystal layer to control a movement of liquid crystal molecules in the liquid crystal layer.

* * * * *